United States Patent [19]

Cuns-Rial et al.

[11] Patent Number: 5,052,577

[45] Date of Patent: Oct. 1, 1991

[54] CONTAINER ASSEMBLY

[75] Inventors: Frank Cuns-Rial, Randolph; David C. Lippert, Westwood, both of Mass.

[73] Assignee: Armstrong Laboratories, Inc., West Roxbury, Mass.

[21] Appl. No.: 432,572

[22] Filed: Nov. 7, 1989

[51] Int. Cl.[5] ..... B65D 41/10

[52] U.S. Cl. ..... 220/310; 220/620; 215/327

[58] Field of Search ..... 220/310, 378, 618, 619, 220/620; 215/325, 327

[56] References Cited

U.S. PATENT DOCUMENTS

| | | | |
|---|---|---|---|
| 700,576 | 5/1902 | Thompson | 220/620 |
| 889,872 | 6/1908 | Conrad | 220/310 X |
| 1,669,512 | 5/1928 | Fitzgerald | 220/310 |
| 1,702,541 | 2/1929 | Heinze | 220/310 |
| 2,334,041 | 11/1943 | Scott | 220/620 X |
| 2,335,647 | 11/1943 | Chamberlain | 220/310 |
| 2,767,899 | 10/1956 | Brown | 220/620 X |
| 3,581,958 | 6/1971 | Meshberg | 222/542 |
| 3,952,677 | 4/1976 | Hartman et al. | 113/120 |
| 4,621,964 | 11/1986 | Radtke et al. | 413/9 |
| 4,795,045 | 1/1989 | Radtke | 215/326 |
| 4,813,576 | 3/1989 | Greenebaum | 222/394 |

*Primary Examiner*—Stephen P. Garbe
*Assistant Examiner*—Nova Stucker
*Attorney, Agent, or Firm*—Wolf, Greenfield & Sacks

[57] ABSTRACT

A mounting cup having a rectilinear peripheral rim which is crimped to an annular rounded bead which circumscribes an opening defined by a container. The peripheral rim is formed to have rectilinear profile which is substantially different from the round profile of the annular rounded bead both before and after crimping.

6 Claims, 4 Drawing Sheets

CONTAINER ASSEMBLY

FIELD OF THE INVENTION

The present invention relates to a container assembly and, more particularly, to an improved mounting cup for a container assembly.

BACKGROUND OF THE INVENTION

The basic shape, dimensions, and method of manufacture of aerosol metal containers and their companion mounting cups have become relatively standardized. Typically, the containers are made of tin plated steel or aluminum and are provided at one end with an opening which is circumscribed by an annular rounded bead. The peripheral rim of the mounting cup is crimped to the annular rounded bead joining the two parts together.

Aluminum containers are generally formed by common metal forming processes such as extrusion or cold drawing. In these processes, a flat piece of metal is formed into a hollow cylindrical body. The cylinder has a flat closed base on one end and an opening on the other end. The open end of the cylinder undergoes forming operations until the desired neck and opening dimensions are reached. The edges of the container defining the opening are then curled over to form the rounded bead, similar to a hollow annular shoulder.

Conventional mounting cups have a peripheral rim which is capable of being crimped to the annular rounded bead located on the aerosol container. Often, a plastic or rubber material, such as a gasket, is interposed between the mounting cup and the metal aerosol container for ensuring a proper seal.

With known mounting cups for metal containers, the Peripheral rim is formed in a substantially inverted U-shape so as to correspond to the shape of the curled end of the container as nearly as possible, the underlying theory being that such a shape will promote sealing between the mounting cup and the container. The peripheral rim of the mounting cup is placed upon the annular rounded bead of the container with the gasket material disposed therebetween. The mounting cup is then crimped by an expanding collet to urge the peripheral rim into sealing engagement with the annular rounded bead of the container.

As a consequence of the forming operation for aluminum container bodies, grooves known as eyelashes develop longitudinally along the internal surface of the container. Depending upon the dimensions of the groove and the physical characteristics of the contents of the container, the solution and/or propellant in the container may escape from the container along the grooves. Accordingly, it has become necessary to improve the seal between the mounting cup and the aerosol container.

Numerous sealing methods and devices have been proposed for improving the seal between the peripheral rim of the mounting cup and the container body. Generally, these improvements involving interposing a sealing material between the annular rounded bead and the mounting cup rim. Other attempts to improve the seal between the mounting cup and the container body include utilizing mounting cups and container bodies formed from a metallic sheet material which had been precoated or laminated with a plastic sealing material. The laminated surface is thought to provide a better seal when the mounting cup is secured or crimped to the container body.

The shape of the mounting cup has been relatively untouched in the search for a better sealing container assembly. The controlling belief has been that an effective seal is obtained by forming the peripheral rim of the mounting cup in a shape matching as similarly as possible to the shape of the annular rounded bead of the metal container.

In U.S. Pat. No. 4,813,576, the shape of the mounting cup rim prior to mounting was modified so as to be different from the shape of the associated metal container bead. However, once attached to the container, the shape of the peripheral rim of the mounting cup closely mirrored the rounded shape of the annular bead. In plastic aerosol containers, mounting cups with rectilinear rims have been used. However, in these embodiments the annular bead is also rectilinearly shaped.

SUMMARY OF THE INVENTION

The problems of the prior art are greatly resolved by the device of the present invention which is an improved mounting cup for a container and particularly a metal aerosol container. In accordance with the invention, a mounting cup is provided having a peripheral rim the shape of which permits a tight seal with the annular rounded bead of the container body.

It is an important characteristic of the present invention that the mounting cup has a peripheral rim having a geometry substantially different from the annular rounded bead of the container body to which it is crimped. While the cross-section of the annular bead of the container body is generally round or elliptical, the peripheral rim of the mounting cup has a rectilinear cross-section. Unlike known mounting cups, the peripheral rim of the mounting cup of the present invention is not intended to resemble the cross-section of the annular rounded bead.

An advantage believed to be provided by the present invention is that the difference in profile between the rectilinear shape of the peripheral rim and the round geometry of the annular rounded bead of the container body provides room for a gasket interposed between the two parts to migrate laterally and away from the point of maximum downward compression.

In accordance with the present invention, the mounting cup is positioned on the container body so that the annular rounded bead of the container body is disposed inside of a channel defined by the peripheral rim. As discussed above, a gasket may be interposed between the peripheral rim and the annular rounded bead. Once properly positioned, a downward pressure is applied and a collet type device is used to crimp the peripheral rim so that it clamps the annular rounded bead thereby rigidly affixing the mounting cup to the container body.

In a preferred embodiment of the invention an inside crimp is used to affix the mounting cup to the container body. It is possible, however, to use an outside crimp for attaching the two elements.

These and other features of the present invention will be more clearly understood by referring to the following detailed description in conjunction with the attached Drawing in which like reference numbers refer to like elements throughout the various figures.

DETAILED DESCRIPTION OF PREFERRED EMBODIMENTS

At the outset the invention is described in its broadest overall aspects with a more detailed description following. In its broadest aspects the present invention is a method and device for providing a tight seal between a mounting cup and a metal container body. The invention includes a mounting cup having a peripheral rim of rectilinear crosssection for affixing to an annular rounded bead of a cylindrical container body. A gasket is preferably interposed between the peripheral rim and the annular rounded bead and, due to the geometry of the peripheral rim, upon downward compression the gasket is able to migrate to provide an optimum seal.

Figure 1:
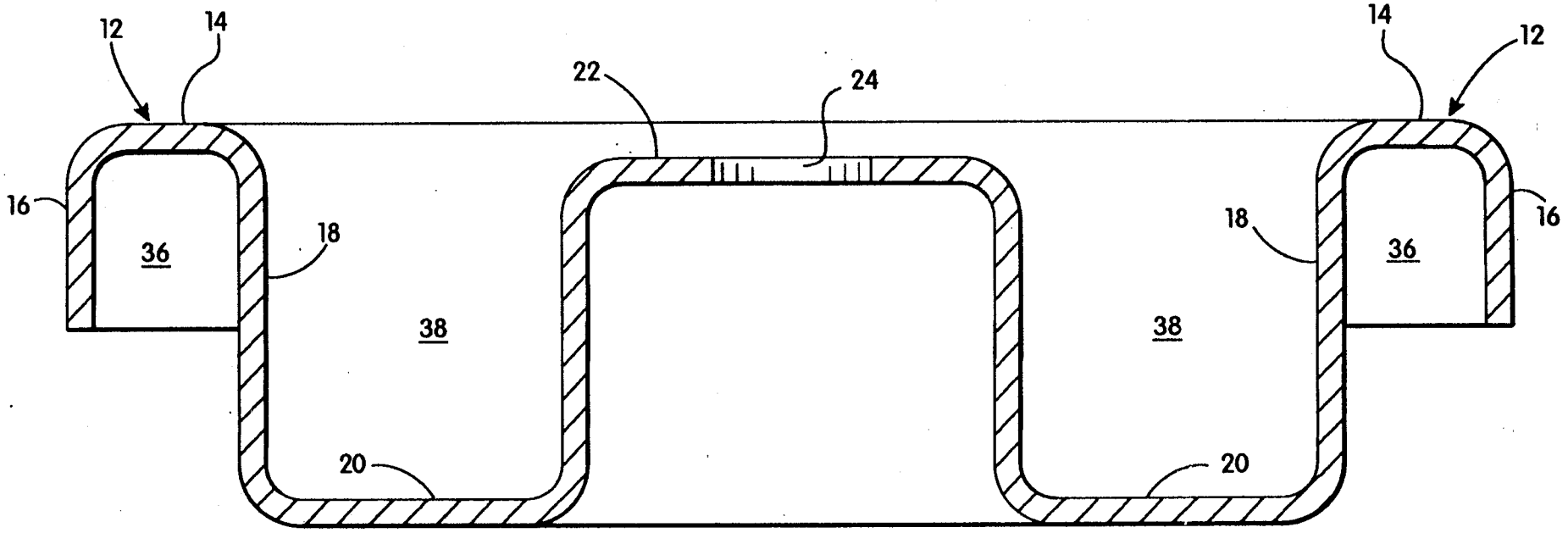
FIG. 1 is a cross-sectional view of a mounting cup in accordance with the present invention.

In FIG. 1 there is shown a cross-sectional view of a mounting cup 10 formed in accordance with the present invention. The mounting cup 10 generally comprises a central hub portion 22 which defines a circular opening 24 within which a valve assembly (not shown) can be positioned. The valve assembly is ultimately used for placing the area within the container in fluid communication with the area outside of the container when so desired. Such valve assemblies are generally known in the art and do not, therefore, constitute a part of this invention. It should be understood that any typical valve assembly will be suitable for use in conjunction with the present invention.

Projecting radially outward from the central hub portion 22 is a bottom base 20. The bottom base 20 lies in a plane substantially perpendicular to a central longitudinal axis of the central hub portion 22 and serves as a transitional area between the central hub portion 22 and a peripheral rim 12. The peripheral rim 12 is formed of an inner wall 18 which, prior to crimping as described in greater detail below, extends substantially perpendicularly from the bottom base 20. In this precrimping state, the inner wall 18 can be said to define a cylinder which is co-axial with the central hub portion 22. Projecting radially outwardly from a top end of the inner wall 18 is a horizontal edge 14 which lies in a plane substantially parallel to the bottom base 20. The geometry of the peripheral rim 12 is completed by an outer wall 16 which defines a cylinder having a central longitudinal axis which is also coaxial with the longitudinal axis of the central hub portion 22.

As so described, it can be understood that the inner wall 18, the horizontal edge 14, and the outer wall 16 cooperate to form a peripheral edge 12 with a rectilinear geometry. The peripheral edge, therefore, defines a rectilinear annular channel 36 which circumscribes the mounting cup 10.

Figure 2:
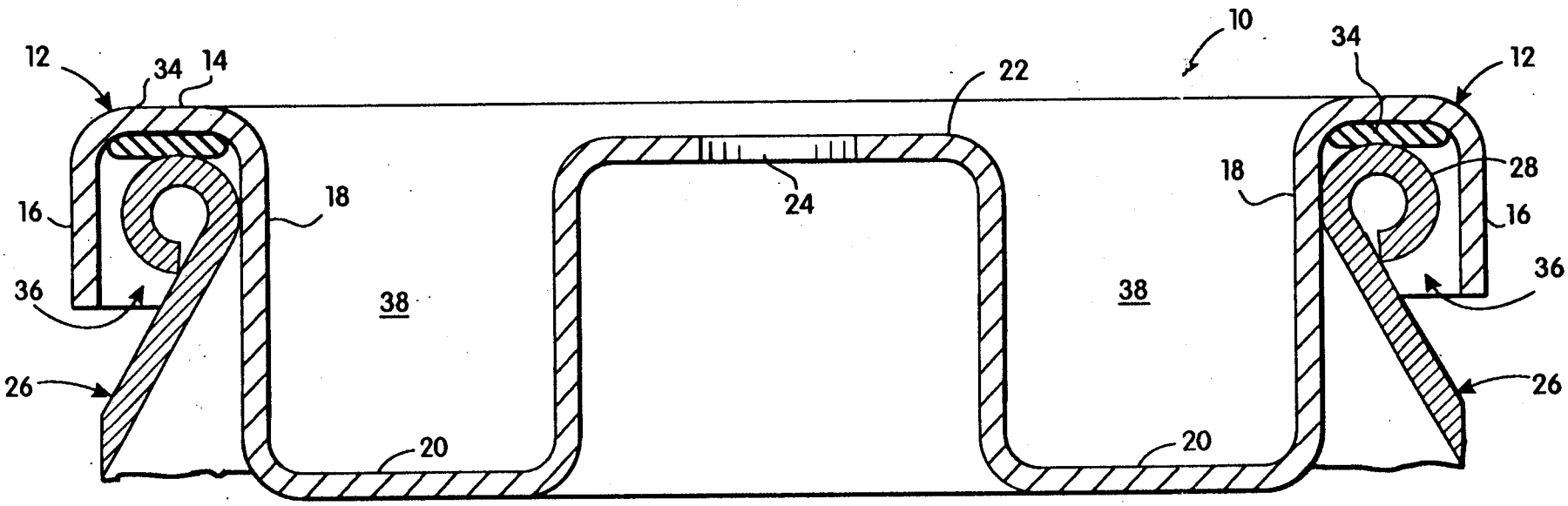
FIG. 2 is a cross-sectional view of a mounting cup in accordance with the present-invention shown positioned on an container body prior to crimping.

FIG. 2 shows the positioning of the mounting cup 10 over a cylindrical container 26, the top open end of which is shown in this figure. Preferably, the container body 26 has been coated with a plastic such as an epoxy phenolic to optimize resistance to corrosion from the components to be contained therein. As depicted in the figure, the mounting cup 10 is positioned so that the annular curled or rounded bead 28 resides within the annular channel 36 defined by the peripheral rim 12. The face of the annular rounded bead above the center thereof has preferably been machined to remove any eyelashing or other surface defects. A gasket 34 is preferably positioned between the annular rounded bead 28 and the peripheral rim 12 to promote sealing therealong. While many types of gaskets can be used as will be readily apparent to those skilled in the art, butyl gaskets have been found to be particularly effective. When the peripheral rim 12 is crimped in order to rigidly affix the mounting cup 10 to the container 26, the gasket 34 will be compressed and, in accordance with the present invention, displaced. This action will ensure that the pressurized solution to be stored within the container 26 is prohibited from passing between the annular rounded bead 28 and the peripheral rim 12.

Conventional wisdom has dictated that known mounting cups be provided with a peripheral rim the geometry of which closely resembles the geometry of the annular rounded bead 28. The philosophy has been that increasing the contact area between the two components promotes efficient sealing. As clearly represented in the Drawing, however, the design of the present invention is predicated on the fact that efficient sealing is best served when the peripheral rim 12 and the annular rounded bead 28 have different geometries both before and after crimping.

Once properly positioned over the opening of the container 26, the mounting cup 10 will undergo a process known as crimping which serves to securely affix the mounting cup and metal container together. In a preferred embodiment of the invention, a capseat (not shown) is located against the horizontal edge 14 and urged thereagainst to securely position the mounting cup relative to the metal container and to squeeze the gasket. During this process an annular expandable collet (not shown) is inserted into an inner volume 38 defined by the mounting cup 10. In its unexpanded form, the collet will be capable of inserting into the inner volume 38 without deflecting any of the components of the mounting cup 10.

Figure 3:
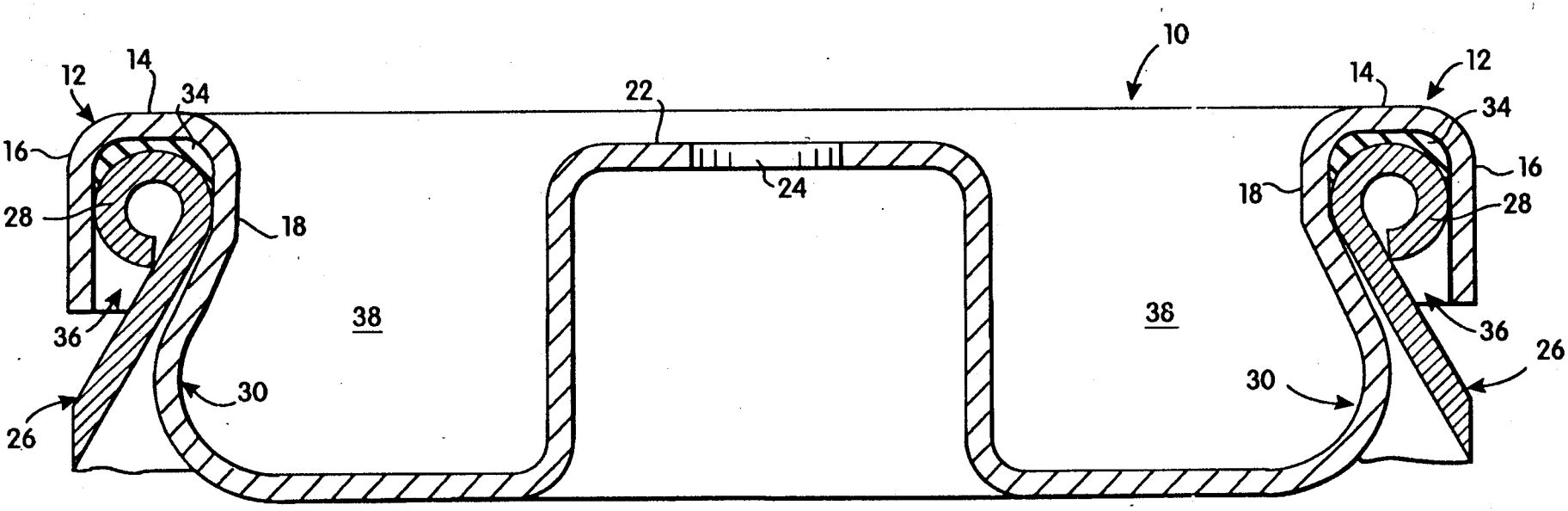
FIG. 3 is a cross-sectional view of a mounting cup in accordance with the present invention shown rigidly affixed to a container body after inside crimping.

Once the collet is properly inserted into the inner volume 38, and while the downward pressure exerted by the capseat is maintained it will be expanded radially outwardly to deform the inner wall 18 of the peripheral rim 12 in a manner as depicted in FIG. 3. As shown in the figure, this crimping creates an inner deflected region 30 which will prevent the mounting cup 10 from being removed from the container 26. As is clear in the figure, however, even after the crimping process the profile of the peripheral rim 12 remains substantially different from the profile of the annular rounded bead 28.

The crimping action also causes the gasket 34 to be displaced. It is the degree of displacement afforded by the profile of the peripheral rim 12 that is believed to provide the superior sealing characteristics of the present invention. Due to the rectilinear profile of the peripheral rim 12, when the peripheral rim 12 is crimped the gasket 34 is able to migrate both laterally as well as away from points of maximum compression.

Known mounting cups do not afford this degree of gasket freedom. While the fact that their peripheral rims have the same profile as the annular rounded bead to which they are attached increases the contact area between the two elements, it also eliminates any free space to which the gasket 34 can migrate. As a result, it is believed that the gasket 34 is unable to spread out to increase its sealing area or reduce its thickness at points of maximum compression. When the gasket 34 is forced to maintain a uniform thickness over the entire circumference of the annular rounded bead 28 there is the possibility of leakage at points enjoying lower compressive forces.

By employing a peripheral rim 12 having a rectilinear geometry, the present invention permits the gasket 34 to be displaced to maximize its effect. The gasket 34 is allowed to spread inwardly over the machined area of the annular rounded bead 28 to increase its sealing area and prevent corrosion. The gasket 34 is also allowed to spread outwardly over the machined area of the annular rounded bead 28 to increase its sealing area.

Figure 4:
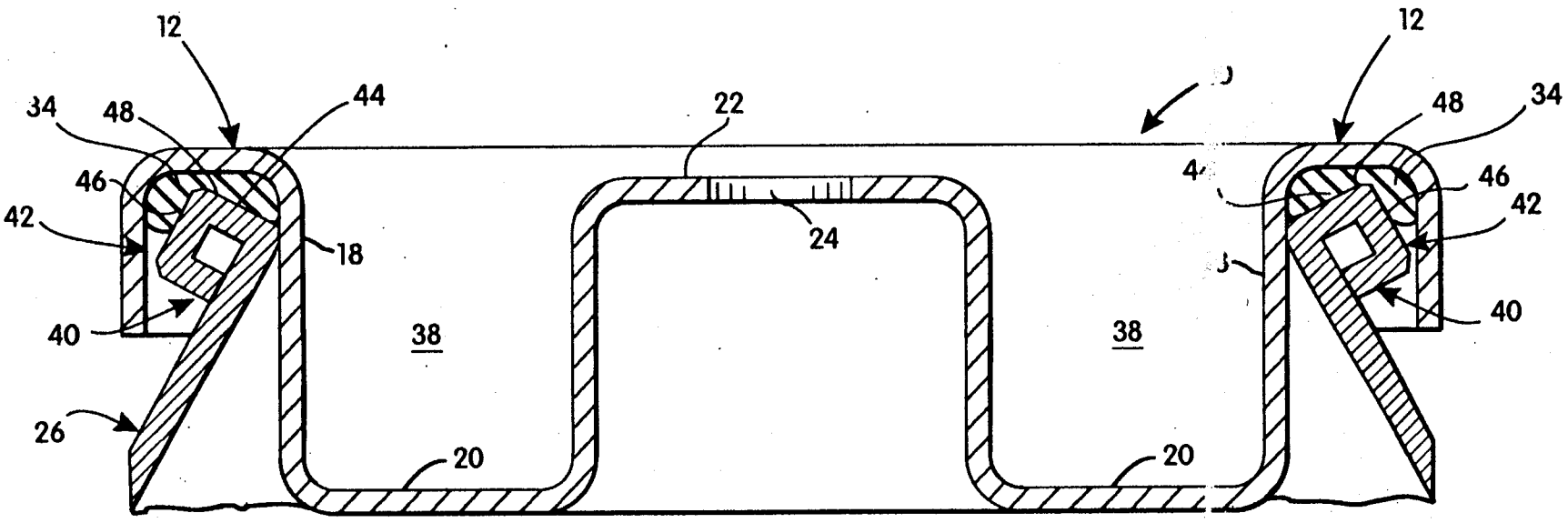
FIG. 4 is a cross-sectional view of a mounting cup in accordance with the present invention shown positioned on a container body having an annular rounded bead which has a triangularly shaped top annular portion.

In an alternate embodiment of the invention, as depicted in FIG. 4, the annular rounded bead 40 has a triangularly shaped top annular portion 42 having a first side 44 and a second side 46 which downwardly diverge from a common edge 48 towards the container 26. The top annular portion has been machined so that at least one of the first and second sides is flat or, alternatively, both sides are flat. The top annular portion's triangular shape permits advantageous positioning with the gasket 34 and the peripheral rim 12 to provide a particularly effective seal when the peripheral rim 12 is crimped. The surface of the annular rounded bead 40 preferably has been machined to remove any eyelashing or other surface defects.

The present invention has been found to be particularly useful for storing and dispensing saline solution propelled with nitrogen gas. Known containers of this type have typically been constructed with mounting cups having curved peripheral rims. Although the present invention has been disclosed solely with respect to metal containers, it is believed that application of mounting cups with rectilinear cross-sections to glass or plastic aerosol containers with annular rounded beads will also be advantageous.

In order to further illustrate the invention, the following examples are provided. It is to be understood, however, that the examples are included for illustrative purposes only and are not intended to limit the scope of the invention as set forth in the accompanying claims.

EXAMPLE 12 oz. saline metal containers of three different well-known brands ("Brands A, B, and C") were joined by internal crimping to conventional mounting cups and mounting cups according to the present invention. A .047" SHORE 80 Butyl gasket was interposed prior to crimping. Each container was filled with saline solution, crimped, pressurized with nitrogen gas to approximately 120 PSIG and then water-bath tested for leaks. The containers were stored for ninety days in a heat room at 135° F. ±5° F. After ninety days the pressure in the containers was determined by testing with an Omega Engineering (Stanford, Connecticut) pressure transducer, model no. 270323-P, which was modified to reduce the dead volume to less than 50 microliters. A pressure digital display monitor was used to display the pressure readings measured by the modified pressure transducer. To obtain accurate measurements, the final reading of the pressure of a container obtained by use of the modified pressure transducer was corrected by adding (if the initial reading was negative) or subtracting (if the initial reading was positive) to the final reading the value of the initial reading. The pressure measurements were taken within five minutes after removal of the containers from the heat room.

| | P. Int. | | P. Final | | | | |
|---|---|---|---|---|---|---|---|
| Type | Av. | S.D. | Av. | S.D. | Qty. | Δ Ave. | Δ S.D. |
| Brand A (Rd.) | 121.0 | 2.3 | 98.6 | 25.51 | 100 | −22.4 | 23.21 |
| Brand B (Rd.) | 115.2 | 7.14 | 54.7 | 34.43 | 100 | −60.5 | 27.29 |
| Brand C (Rd.) | 120.8 | 2.33 | 118.5 | 10.96 | 100 | −2.3 | 8.63 |
| Brand A (Rect.) | 117.1 | 3.36 | 120.7 | 3.16 | 100 | +3.6 | 0.2 |
| Brand B (Rect.) | 122.2 | 2.33 | 123.6 | 2.57 | 100 | +1.4 | 0.24 |
| Brand C (Rect.) | 118.6 | 2.83 | 121.3 | 3.00 | 100 | +2.7 | 0.18 |

As the data in the Example indicates, none of the containers utilizing the mounting cup of the present invention (Rect.) suffered any leakage. Conversely, the containers utilizing conventionally shaped mounting cups (Rd.) encountered leakage and in the case of Brand A and Brand B containers that leakage was significant.

What is claimed is:

1. A container assembly comprising:

a cylindrical body having a closed end and an opening at an opposed end, said cylindrical body having an annular bead circumscribing said opening;

a mounting cup comprising a central portion having an annular bottom base, said mounting cup having a peripheral rim circumscribing said bottom base, said peripheral rim being defined by an inner wall extending perpendicularly from said annular bottom base, a horizontal wall extending perpendicularly from said inner wall, and an outer wall extending perpendicularly from said horizontal wall, said inner wall, said horizontal wall and said outer wall together defining a rectilinear annular channel adapted to receive said annular bead, wherein said central portion is positioned within said opening, said annular bead is received within said rectilinear chamber and said inner wall of said peripheral rim is crimped to said annular bead; and a gasket interposed between said annular bead and said peripheral rim.

2. The container assembly as set forth in claim 1 wherein said annular bead is rounded.

3. The container assembly as set forth in claim 1 wherein said cylindrical body is formed of aluminum.

4. The container assembly as set forth in claim 3 wherein said aluminum cylindrical body is curled over at said opening thereof to define said annular bead.

5. The container assembly as set forth in claim 1 wherein said annular bead has a top annular portion having a first side and a second side, wherein said first side and said second side downwardly diverge from a common edge towards said container and at least one of said first and second sides is flat.

6. The container assembly as set forth in claim 5 wherein said first side and said second side of said top annular portion are flat.

* * * * *